US005356700A

United States Patent [19]

Tanaka et al.

[11] Patent Number: 5,356,700

[45] Date of Patent: Oct. 18, 1994

[54] AROMATIC POLYAMIDE FIBER-POLYESTER FIBER-BLENDED SPUN YARN FABRIC

[75] Inventors: Makoto Tanaka, Toyonaka; Genji Nakayama, Ibaraki; Noboru Takimoto, Yao; Koichi Hosoyama, Ikoma, all of Japan

[73] Assignee: Teijin Limited, Osaka, Japan

[21] Appl. No.: 952,540

[22] PCT Filed: Jun. 11, 1991

[86] PCT No.: PCT/JP91/00778

§ 371 Date: Dec. 10, 1992

§ 102(e) Date: Dec. 10, 1992

[87] PCT Pub. No.: WO91/19842

PCT Pub. Date: Dec. 26, 1991

[30] Foreign Application Priority Data

Jun. 11, 1990 [JP] Japan ..... 2-149866

[51] Int. Cl.[5] ..... D03D 15/12

[52] U.S. Cl. ..... 428/229; 2/2; 139/420 R; 428/920

[58] Field of Search ..... 428/229, 920; 139/420 R

[56] References Cited

U.S. PATENT DOCUMENTS 4,868,041 9/1989 Yamagishi et al. .

FOREIGN PATENT DOCUMENTS 3307449 9/1983 Fed. Rep. of Germany .
196741 8/1988 Japan .
2152542 8/1985 United Kingdom .
2183265 6/1987 United Kingdom .

*Primary Examiner*—James C. Cannon
*Attorney, Agent, or Firm*—Burgess, Ryan & Wayne

[57] ABSTRACT

A fiber fabric useful for flame-resistant garment is composed of yarns comprising a blend of 65 to 95% by weight of an aromatic polyamide fiber-containing fiber component with 5 to 40% by weight of a polyester fiber component; the aromatic polyamide fiber-containing fiber component comprising 50 to 100% by weight of aromatic polyamide fibers and 0 to 50% by weight of cellulose fibers and the fiber fabric having a limiting oxygen index of 26 or more.

8 Claims, 2 Drawing Sheets

AROMATIC POLYAMIDE FIBER-POLYESTER FIBER-BLENDED SPUN YARN FABRIC

TECHNICAL FIELD

The present invention relates to a fabric composed of blended yarns of aromatic polyamide fibers and polyester fibers. More particularly, the present invention relates to an aromatic polyamide fiber-polyester fiber blended yarn fabric suitable for flame-resistant attire that are worn by firemen, and other persons potentially exposed to fire including operators in electric power and chemical factories.

BACKGROUND ART

As fibers that are resistant to combustion when exposed to flame, and have no thermal fusibility, cotton and wool fibers treated with a flame-retarder, flame-retardant Vinylon (trademark) and flame-retardant rayon are known and supplied as a flame-retardant cloth-forming material to commercial markets. Those conventional flame-retardant fibers are disadvantageous in that said fibers sometimes do not necessarily have flame resistance or heat resistance sufficient to protect the wearer when exposed to temperatures of 200° C. or more for an extended period.

The fabric made from the above-mentioned flame retarder-treated fibers essentially have no heat-setting properties. Therefore, a cloth made from the flame retarder-treated fiber is disadvantageous in that the trim appearance of the cloth is nullified by vanishing pleats or wrinkles forming thereon during wear, and thus the garment must be ironed after every wear. Wrinkles are also formed after laundering, thereby necessitating ironing before use if a trim appearance is required.

On the other hand, carbonized rayon fibers and polybenzimidazole fibers are known as fibers having excellent heat resistance and flame resistant, and are supplied for practical use as a material for flame resistant cloth. However, these fibers are poor in dyeability and a resultant cloth made from said fibers provides an unsatisfactory appearance, texture and mechanical strength, whereas the fibers have a high heat resistance and flame resistance. Accordingly, poly(metaphenyleneisophthalamide) fibers having excellent heat and flame resistance, mechanical strength sufficiently high when formed into a working cloth, and satisfactory dyeability in every color, are now widely used as a material for flame resistant cloth.

Nevertheless, the poly(metaphenyleneisophthalamide) fibers are essentially heat resistant fibers and thus have poor heat-setting properties. Thus, a fabric comprising, as the main component thereof, such fibers exhibits poor form-retaining properties and dimensional stability similar to those of a fabric made from cellulose fibers. Therefore, when a cloth sewn from the fabric is worn, pleats on the cloth vanish and wrinkles are formed, which degrade the appearance of the cloth. Therefore, the cloth must be ironed after every wear or laundered. However, since the functional properties, for example, heat resistance, flame resistance and flame retardance, of the poly(metaphenyleneisophthalamide) fibers are considered to be important, an elimination of the above-mentioned disadvantages, namely, low form-retaining properties and dimensional stability, of the fibers have not yet been considered.

On the other hand, polyester fibers have excellent heat-setting properties, and in a cloth made from the polyester fibers, pleats retain their form and wrinkles are not formed during wear. Also, the cloth is advantageous in that wrinkles do not form on the cloth after laundering, and thus is widely utilized as a wash-and-wear cloth.

In a fiber-blend fabric containing cellulose fibers, for example, cotton and rayon fibers, having no heat-setting properties, when the blending ratio of the polyester fibers to the cellulose fibers is adjusted to 65 weight%: 35 weight%, the resultant fabric exhibits relatively high form-retaining properties and dimensional stability and thus is widely and practically used.

DISCLOSURE OF THE INVENTION

In consideration of the above-mentioned problems of the prior arts, the inventors of the present invention have strived to improve the form-retaining properties of a fabric comprising, as the main component thereof, aromatic polyamide fibers. As a result, it was discovered that an aromatic polyamide fiber-polyester fiber-blended spun yarn fabric having good form-retaining properties and dimensional stability can be obtained without lowering the heat resistance, flame retardance and flame resistance, by blending the aromatic polyamide fibers and the polyester fibers in a blending ratio within a specific range different from the customary blending ratio.

The present invention was completed based on the conclusion as proposed above.

The aromatic polyamide fiber-polyester fiber-blended spun yarn fabric of the present invention comprises a fabric made of spun yarns comprising a uniform blend of:

(A) 60 to 95% by weight of a first fiber component consisting of 50 to 100% by weight of aromatic polyamide fibers and 0 to 50% by weight of cellulose fibers; and (B) 5 to 40% by weight of a second fiber component consisting of polyester fibers, and has a limiting oxygen index of 26 or more.

BEST MODE OF CARRYING OUT THE INVENTION

Figure 1:
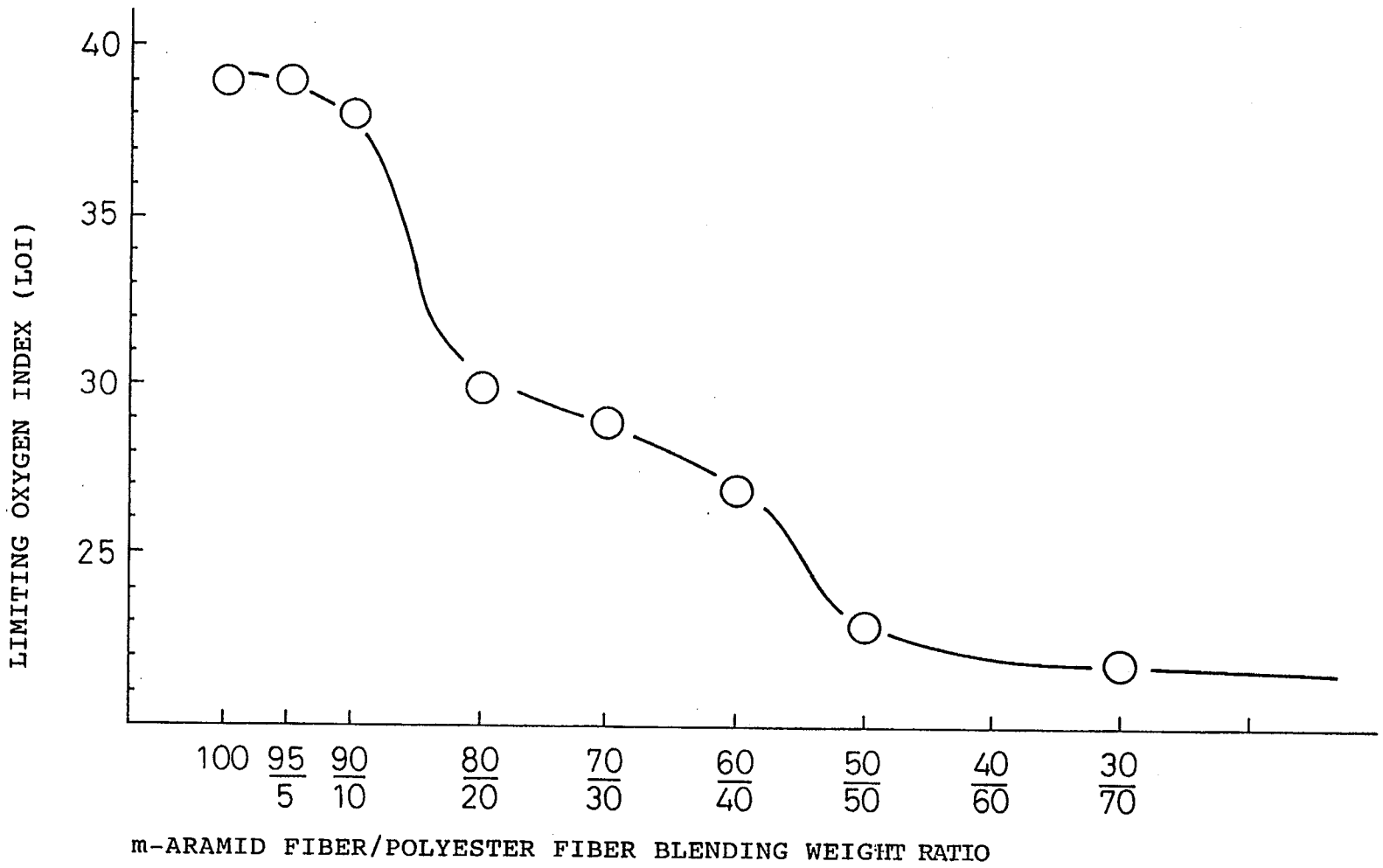
FIG. 1 is a graph showing a relationship between a blending ratio, in weight, of meta-type aramid fibers to polyester fibers in a meta-type aramid fiber-polyester fiber-blended spun yarn fabric, and a limiting oxygen index (LOI) of the corresponding blended spun yarn fabric.

The aromatic polyamide fibers usable for the present invention preferably consist of 80 to 100% by weight of fibers comprising a meta-type aramid and 0 to 20% by weight of fibers comprising a copolymerized para-type aramide.

The above-mentioned meta-type aramid fibers include (a) polymetaphenyleneisophthalamide fibers and, (b) fibers comprising a mixture of polymetaphenyleneisophthalamide with at least one member selected from the group consisting of:

(i) a polycondensation reaction product of an amine component comprising 35 to 100 molar% of xylenediamine and 0 to 65 molar% of at least one aromatic diamine with an acid component comprising at least one aromatic dicarboxylic acid;

(ii) a polycondensation reaction product of a diamine component comprising at least one phenylenediamine compound having a phenylene group substituted with at least one alkyl group having 1 to 4 carbon atoms and at least one unsubstituted aromatic diamine compound, with an acid component comprising at least one aromatic dicarboxylic acid, and (iii) a polycondensation reaction product of a diamine component comprising 40 to 100 molar% of at least one phenylenediamine compound having a phenylene group substituted with 1 to 4 halogen atoms and 0 to 60 molar% of at least one unsubstituted aromatic diamine compound, with an acid component comprising at least one aromatic dicarboxylic acid.

The meta-type aramid usable for the present (i) a polycondensation reaction product of an amine component comprising 35 to 100 molar% of xylenediamine and 0 to 65 molar% of at least one aromatic diamine with an acid component comprising at least one aromatic dicarboxylic acid;

(ii) a polycondensation reaction product of a diamine component comprising at least one phenylenediamine compound having a phenylene group substituted with at least one alkyl group having 1 to 4 carbon atoms and at least one unsubstituted aromatic diamine compound, with an acid component comprising at least one aromatic dicarboxylic acid, and (iii) a polycondensation reaction product of a diamine component comprising 40 to 100 molar% of at least one phenylenediamine compound having a phenylene group substituted with 1 to 4 halogen atoms and 0 to 60 molar% of at least one unsubstituted aromatic diamine compound, with an acid component comprising at least one aromatic dicarboxylic acid.

The meta-type aramid usable for the present invention preferably has an intrinsic viscosity of 0.8 to 4.0, determined at a concentration of 0.5 g/100 ml in a concentrated sulfuric acid at a temperature of 30° C. The above-mentioned intrinsic viscosity is more preferably from 1.0 to 3.0.

The copolymerized para-type aramid for forming the copolymerized para-type aramid fibers usable for the present invention include those comprising recurring units of the formula (I):

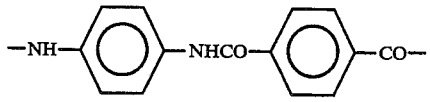

(I)

Each of the meta-type aramid fibers and the copolymerized para-type aramid fibers may contain an additive, for example, flame retarder, coloring material, light resistance-improving agent, flame resistance-improving agent, delusterant and electrically conducting agent, unless the additive hinders the purpose, functions and effects of the present invention.

The aromatic polyamide fibers usable for the present invention each preferably have a fiber length of 25 to 200 mm, more preferably 35 to 100 mm and an individual fiber denier of 0.4 to 3, more preferably 0.5 to 2.

In the case that the first fiber component contains cellulose fibers blended with aromatic polyamide fibers, the cellulose fibers are preferably selected from cotton and rayon fibers and flame-retardant rayon fibers containing a flame retarder. In the blend of the aromatic polyamide fibers with the cellulose fibers, the content of the aromatic polyamide fibers is 100 to 50% by weight and the content of the cellulose fibers is 0 to 50% by weight. When the content of the cellulose fibers is more than 50% by weight, the resultant fabric exhibits an insufficiently low heat resistance and flame resistance, and the form-retention of the fabric is unsatisfactory.

The polyester fibers usable for the present invention include polyethylene-terephthalate fibers, polybutyleneterephthalate fibers and polynaphthyleneterephthalate fibers that are commonly employed in clothes or industrial materials. The polyester polymer from which the polyester fibers are made may be copolyester fibers containing, as a copolymerization component, a dicarboxylic acid different from terephthalic acid or a diol component different from ethylene glycol, butylene glycol and naphthylene glycol, unless the copolymerization component causes the properties of the resultant polyester fibers to deteriorate. Also, the polyester fibers may be modified polyester fibers containing various modifying additives, for example, a flame retarder and antistatic agent.

The polyester fibers usable for the present invention preferably have a fiber length of 25 to 200 mm, more preferably 35 to 110 mm, and an individual fiber denier of 0.4 to 3, more preferably 0.5 to 2.

In the present invention, the blending ratio, in weight, of the second fiber component, namely the polyester fibers to the first fiber component is very important.

Generally, in a polyester fiber-cellulose fiber-blended spun yarn fabric, to obtain a fabric having relatively high form retention and dimensional stability from a blend of polyester fibers having high heat-setting properties with cotton or rayon fibers having no heat-setting properties, the blending weight ratio of the polyester fibers to the cellulose fibers should be 50:50 or more, preferably 65:35.

In this type of blended spun yarn fabric, it is known that if the content of the polyester fibers is less than 50% by weight, the resultant fabric exhibits unsatisfactory form retention and dimensional stability.

However, in the present invention, it has been found for the first time that in the case that a first fiber component comprising aromatic polyamide fibers alone or a blend of aromatic polyamide fibers with cellulose fibers is blended with a second fiber component comprising polyester fibers, even if the second fiber component is blended in a small amount, for example, 5% by weight, the resultant fabric exhibits remarkably enhanced form retention and dimensional stability in comparison with that of a fabric containing no second fiber component, and even if the content of the second fiber component is increased to more than 40% by weight, the effect of the second fiber component is no longer enhanced.

FIG. 1 shows a relationship between a blending ratio, in weight, of meta-type aramid fibers (the first fiber component) to polyester fibers (the second fiber component) and a limiting oxygen index (LOI) of a fabric made of blended spun yarns of the above mentioned fiber blend. The limiting oxygen index (LOI) of the fabric represents a degree of fire retardance of the fabric. The higher the limiting oxygen index, the higher the degree of fire retardance of the fabric.

In FIG. 1, an increase in the blending weight ratio of the polyester fibers to the meta-type aramid fibers results in a decrease in the degree of fire retardance. However, the weight content of the polyester fibers and the degree of fire retardance are not always in a linear proportional relationship. Namely, when the content of the polyester fibers in the fabric is in the range of from 0 to 10% by weight, the LOI (fire retardance) of the fabric does substantially not decrease. Then, when the content of the polyester fibers in the fabric is in the range of from 10 to 20% by weight, the LOI (fire retardant) of the fabric decreases significantly with an increase in the content of the polyester fibers. When the content of the polyester fibers in the fabric is in the range of from 20 to 40% by weight, the LOI (fire retardance) of the fabric gradually decreases with an increase in the content of the polyester fibers.

When the content of the polyester fibers in the fabric is in the range of 50% by weight or more, the LOI (fire retardance) value of the fabric is substantially constant and substantially equal to that of a fabric consisting of the polyester fibers alone.

As FIG. 1 clearly shows, a blended spun yarn fabric having a limiting oxygen index of 26 or more, and thus exhibiting a high fire retardance has been obtained for the first time by the present invention, by limiting the content of the polyester fibers in the aromatic polyamide fiber (first fiber component)-polyester fiber (second fiber component) blended spun yarn fabric to a range of from 5 to 40% by weight.

A fabric having a LOI of less than 26 is burned completely in a fire retardance-evaluation test in accordance with JIS L 1091, A-4 method.

Further, when the content of the polyester fibers exceeds 40% by weight, the resultant fabric exhibits remarkable fusibility at a high temperature and is not suitable for flame-resistant, heat resistant wear.

As is understood from the above-mentioned phenomena, it is important that the first fiber component consisting of aromatic polyamide fibers alone or a mixture of the aromatic polyamide fibers with cellulose fibers is uniformly blended in an amount of 95 to 60% by weight, preferably 80 to 70% by weight, with 5 to 40% by weight, preferably 20 to 30% by weight, of the second fiber component consisting of polyester fibers, to provide a fabric free from the defects of a fabric consisting of the aromatic polyamide fibers alone or a mixture of the aromatic polyamide fibers with cellulose fibers, and having enhanced form retention and dimensional stability, excellent heat resistance, flame-resistance and fire retardance. The resultant fabric exhibits a limiting oxygen index of 26 or more.

The aromatic polyamide fiber-polyester fiber blended spun yarn fabric of the present invention having the above-mentioned constitution has superior form retention and dimensional stability and exhibits excellent heat-resistance, flame-resistance and fire retardance, and thus is useful for forming a practical flame-resistant garment. To uniformly blend the above-mentioned different types of fibers, a customary fiber-blending method, for example, an air jet blending method or simultaneous cutting method, can be employed.

When the first fiber component is blended with the second fiber component during a spinning procedure, it is preferable that each of the fibers has a crimp number of about 4 to about 20 crimps per 25.4 mm length.

To provide a colored fabric, a process in which a fabric is produced from a blend of meta type aramid fibers colored by a pigment with polyester fibers dyed in the form of a fiber mass; a process in which a fabric is produced from blended spun yarns comprising meta-type aramid fibers colored with a pigment, polyester fibers dyed in the form of a fiber mass, and non-dyed cellulose fibers, and then the non-dyed cellose fibers in the fabric is dyed; or a process in which a fabric is produced from blended spun yarns comprising non-colored meta-type aramid fibers, non-colored polyester fibers and optionally non-colored cellulose fibers, and then the fabric is subjected to customary dyeing procedures suitable for dyeing each type of fibers, is employed.

In the present invention, when cotton or rayon fibers are used as cellulose fibers, the resultant fabric is preferably subjected to a treatment with a flame-resistant treating agent for cotton, for example, a tetrakis(hydroxyalkyl)phosphonium compound, thereby causing a desired amount of the treating agent to attach to the fibers, so as to further enhance the LOI of the resultant fabric.

To furthermore enhance the fire retardance of the fabric, for example, to obtain a fabric having an LOI of 30 or more, the amount of tetrakis(hydroxyalkyl) phosphonium compound adhered to the fabric should be increased.

To furthermore enhance the LOI of the fabric of the present invention, the following methods can be utilized.

(1) Fire-retardant aromatic polyamide fibers, for example, poly(methaphenyleneisophthalamide) fibers containing a fire retarder and having an LOI of 35 or more, are used as aromatic polyamide fibers.

(2) Fire retardant polyester fibers produced by copolymerizing a fire retarder, for example, a fire-retarding phosphorus-containing compound, for example, carboxyphosphinic acid or phosphonic acid derivative, or 2-carboxy-ethyl-methylphosphinic acid or phosphur-phenanthrene-ring-containing compound (JP-A-52-47891), or other fire retardant polyester fibers produced by imparting a fire-retarder containing a bromine-containing compound, for example, hexabromocyclododecane, to the fibers during a crimping step or fiber-dyeing step, are employed as polyester fibers.

(3) Fire retardant rayon fibers (for example, available under the trademark of Toughvan from Toyobo) having an LOI of 26 or more are employed as cellulose fibers.

In the specification of the present application, the term "form retention of fabric"refers to a performance of the fabric such that during wear of a cloth, the pleats of the cloth are retained and wrinkles are not formed, and after laundering no wrinkles are formed, and thus the fabric maintains its usual form.

Figure 2:
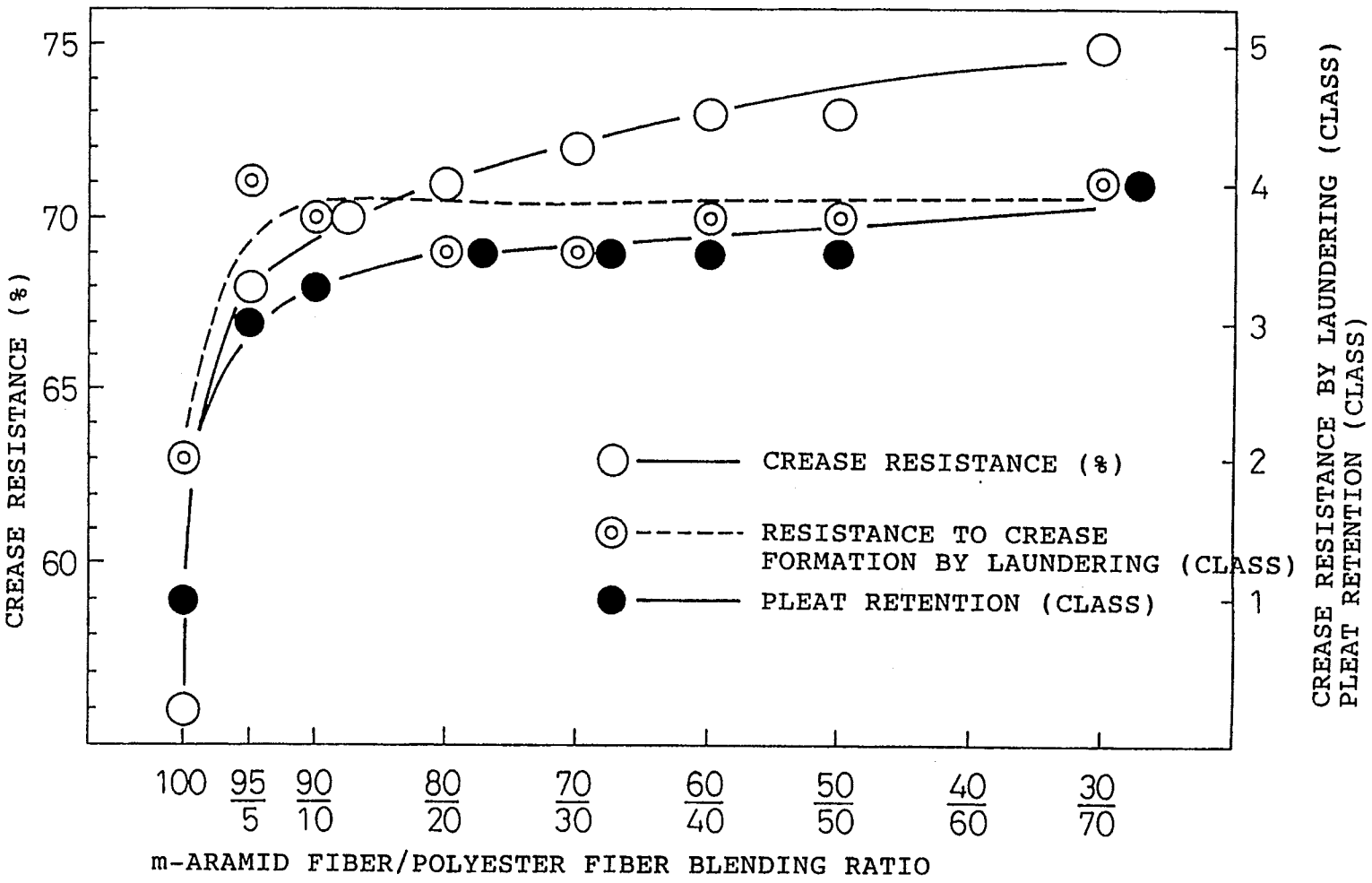
FIG. 2 is a graph showing relationships between a blending ratio, in weight, of meta-type aramid fibers to polyester fibers in a meta-type aramid fiber-polyester fiber-blended spun yarn fabric and crease resistance, resistance to crease formation by laundering and pleat-retention of the corresponding blended spun yarn fabric.

In FIG. 2, a relationship between a blending weight ratio of meta-type aramid fibers to polyester fibers in a blended spun yarn and form retention characteristics (crease resistance, pleat retention, and resistance to crease-formation by laundering) of a fabric produced from the blended spun yarn are shown.

From FIG. 2, it is clear that when the blending weight ratio of the first fiber component to the second fiber component is in the range of from 95/5 to 60/40, the resultant fabric has satisfactory form retention for practical use.

EXAMPLES

The present invention will be further explained by the following examples.

In the examples, the following tests were carried out.

1. Pleat-Formability

Specimens having a length of 25 cm and a width of 25 cm were cut from a fabric in a warp direction of the fabric. On each specimen, lines were drawn at intervals of 5 cm in the width direction of the specimen.

A middle portion of the specimen having a length of 15 cm was folded three times at intervals of 5 cm.

The folded specimen was pressed by a customary pressing machine at an upper press surface temperature of 150° C., under a pressing pressure of 0.6 kg/cm$^2$ for 10 seconds. A vacuum treatment was applied to the pressed specimen for 10 seconds, and then the specimen was cooled to room temperature. The pleat formation of the specimen was observed visually and evaluated as follows Class 5: Very sharp pleats were formed.
Class 4: Sharp pleats were formed.
Class 3: Pleat formation was recognized.
Class 2: Pleat formation was slight.
Class 1: Substantially no pleats were formed.

2. Pleat Retention

A specimen having a pleat-formability of class 5 was subjected to a pleat-forming procedure and laundered in accordance with the method of JIS L 0217-103. The condition of the pleats on the specimen was observed visually and evaluated in 1 to 5 classes in a manner similar to above.

3. Resistance to Crease Formation by Laundering

The laundering was carried out by the JIS L 1096, A method.

Drying: Tumble dry
Treatment: 5 times

The condition of the creases on the specimen was observed visually and evaluated in 1 to 5 classes as follows.

Class 5: No crease formation was recognized.
Class 4: Crease formation was slightly apparent.
Class 3: Crease formation was apparent, and the creased fabric can be used without ironing.
Class 2: Crease formation was clearly apparent, and the creased fabric should be ironed before use.
Class 1: Very significant crease formation was apparent.

4. Crease Resistance (%)

This was measured by the JIS L 1059, B, wet method.

5. Fire Retardance

The JIS K 7201, LOI measurement and JIS L 1091, A-4 method were applied.

Examples 1 to 5 and Comparative Examples 1 to 3

In each of Examples 1 to 5 and Comparative Examples 1 to 3, 100 parts of polymetaphenylene-isophthalamide was mixed with 5 parts of a fire retarder consisting of tris(2,4-dichlorophenyl)phosphate, the mixture was subjected to a customary wet spinning procedures. The resultant undrawn filaments were subjected to a draw-heat setting procedure and a crimping procedure in a customary manner.

Meta-type aramid staple fibers having an individual fiber thickness of 2.0 denier, a fiber length of 51 mm, a crimp number of 11 crimps/2.5 cm and an LOI of 39 were obtained.

The meta-type aramid fibers were blended with polyethyleneterephthalate staple fibers (semi-dull) having an individual fiber thickness of 2.0 denier, a fiber length of 51 mm, a crimp number of 12 crimps/2.5 cm and an LOI of 21 in the blending weight ratio as shown in Table 1.

The blend was converted to blended spun yarns having a woolen yarn count of 2/68$^s$. From the blended spun yarns, a twill fabric was produced with the following weave structure:

$$\frac{2/68^s \times 2/68^s}{88 \text{ yarns}/25.4 \text{ mm} \times 74 \text{ yarns}/25.4 \text{ mm}}$$

The form retention (pleat retention, resistance to crease formation by laundering and crease resistance) and fire retardance (LOI, A-4 method) of the resultant fabric were measured. The test results are shown in Table 1.

TABLE 1

| | Item | Example No. | | | | | | | |
|---|---|---|---|---|---|---|---|---|---|
| | | Comparative Example | Example | | | | | Comparative Example | |
| | | 1 | 1 | 2 | 3 | 4 | 5 | 2 | 3 |
| Composition of blended spun yarn | m-type aramid fibers (wt %) | 100 | 95 | 90 | 80 | 70 | 60 | 50 | 30 |
| | Polyester fibers (wt %) | 0 | 5 | 10 | 20 | 30 | 40 | 50 | 70 |
| Performance of fabric | Pleat formability (class) | 5 | 5 | 5 | 5 | 5 | 5 | 5 | 5 |
| | Pleat retention (class) | 1 | 3 | 3–3.5 | 3.5 | 3.5 | 3.5 | 3.5 | 4 |
| | Resistance to crease-formation by laundering (class) | 2 | 4 | 3.7 | 3.5 | 3.5 | 3.7 | 3.8 | 3.9 |
| | Crease resistance (%) | 56 | 68 | 70 | 71 | 72 | 73 | 73 | 75 |
| | LOI | 39 | 39 | 38 | 30 | 29 | 27 | 23 | 22 |
| | Fire retardance (A-4 method) Carbonization length: cm) | 3.3 | 3.5 | 3.8 | 6.5 | 7.2 | 7.9 | $(*)_1$ | $(*)_1$ |

Note: $(*)_1$. . . Completely burned

Example 6 and Comparative Example 4

In each of Example 6 and Comparative Example 4, blended spun yarns were produced from the same meta-type aramid fibers and polyester fibers as mentioned in Example 1 and fire retardant rayon staple fibers (available under the trademark of Toughvan from Toyobo) having an individual fiber thickness of 1.4 deniers, a fiber length of 44 mm, a crimp number of 8 crimps/25.4 mm) in the blending weight ratio as shown in Table 2.

The blended spun yarns were converted to a twill fabric having the following weave structure:

$$\frac{2/68^S \times 2/68^S}{115 \text{ yarns}/25.4 \text{ mm} \times 58 \text{ yarns}/25.4 \text{ mm}}$$

The form retention and fire retardance of the resultant fabric were measured. The test results are shown in Table 2.

TABLE 2

| Item | | Example No. Example 6 | Comparative Example 4 |
|---|---|---|---|
| Composition of blended spun yarn | m-type aramid fibers (wt %) | 52 | 65 |
| | Polyester fibers (wt %) | 20 | |
| | Fire-retardant rayon fibers (wt %) | 28 | 35 |
| Performance of fabric | Pleat formability (class) | 5 | 5 |
| | Pleat retention (class) | 4 | 1 |
| | Resistance to crease-formation by laundering (class) | 3.8 | 2 |
| | Crease resistance (%) | 76 | 56 |
| | LOI | 29 | 31 |
| | Fire retardance (A-4 method) (Carbonization length: cm) | 8.5 | 7.8 |

Examples 7 to 9 and Comparative Example 5

In each of Examples 7 to 9 and Comparative Example 5, blended spun yarns were produced from the same m-aramid fibers and polyester fibers as mentioned in Example 1 and U.S. cotton fibers having an individual fiber thickness of 1.9 to 3.0 deniers and a fiber length of 20 to 30 mm in the blending weight ratio as shown in Table 3. The blended spun yarns were woven to provide a plain weave having the following structure:

$$\frac{30^S/2 \times 30^S/2}{55 \text{ yarns}/25.4 \text{ mm} \times 54 \text{ yarns}/25.4 \text{ mm}}$$

The fabric was scoured and dried in a customary manner. The dried fabric was immersed in a treating liquid prepared by mixing 20 parts by weight of flame-resistance agent for cotton containing tetrakis(hydroxymethyl)phosphonium (available under the trademark of Nonnen C-617, from Marubishi Yuka Kogyo K.K.), 3 parts by weight of a melamine resin (available under the trademark of Sumitex Resin M-6, from Sumitomo Kagaku Kogyo K.K.), 1 part of a cross-linking catalyst (available under the trademark of Sumitex Accelerator ACX, from Sumitomo Kagaku Kogyo K.K.) and 76 parts by weight of water, while stirring, taking up the fabric from the treating liquid, squeezing the fabric by a mangle, drying the fabric at 110° C. and heat treating the fabric at 150° C. for 2 minutes. The resultant fire retardant fabric was soaped in an aqueous sodium percarbonate solution in a customary manner and then dried.

The resultant fabric was subjected to a form retention test and fire retardance test. The test results are shown in Table 3.

TABLE 3

| Item | | Example No. Example 7 | 8 | 9 | Comparative Example 5 |
|---|---|---|---|---|---|
| Composition of blended spun yarn | m-aramid fibers (wt %) | 80 | 70 | 56 | 70 |
| | Polyester fibers (wt %) | 20 | 30 | 20 | 0 |
| | Cotton (wt %) | 0 | 0 | 24 | 30 |
| Performance of fabric | Pleat formability (class) | 5 | 5 | 5 | 5 |
| | Pleat retention (class) | 4 | 4 | 3.5 | 1 |
| | Resistance to crease-formation by laundering (class) | 4 | 4 | 3.8 | 1.5 |
| | Crease resistance (%) | 81 | 80 | 77 | 52 |
| | LOI | 36 | 35 | 28 | 30 |
| | Fire retardance (A-4 method) (Carbonization length: cm) | 4.5 | 5 | 10 | 9 |

Examples 10 to 12

In each of Examples 10 to 13, blended spun yarns were produced from a blend of the same meta-type aramid fibers, polyester fibers, and fire retardant rayon fibers (Toughvan) as employed in Example 6 and copolymerized para-type aramid fibers (available under the trademark of Technola staple fiber, from Teijin Ltd.) having an individual fiber thickness of 1.5 deniers, a fiber length of 51 mm and a crimp number of 10 crimps/25.4 mm, in the blending weight ratio as shown in Table 4. The blended spun yarns were woven to provide a twill fabric having the following structure:

$$\frac{2/68^S \times 2/68^S}{88 \text{ yarns}/25.4 \text{ mm} \times 74 \text{ yarns}/25.4 \text{ mm}}$$

The form retention and fire retardance of the resultant fabric were tested. The test results are shown in Table 4.

TABLE 4

| Item | | Example No. Example 10 | 11 | 12 |
|---|---|---|---|---|
| Composition of | m-aramid fibers (wt %) | 80 | 65 | 65 |
| | Polyester fibers (wt %) | 15 | 25 | 20 |

TABLE 4-continued

| | Item | Example No. Example 10 | 11 | 12 |
|---|---|---|---|---|
| blended spun yarn | Fire retardant rayon fibers (wt %) | 0 | 0 | 10 |
| | Copolymerized p-aramid fibers (wt %) | 5 | 10 | 5 |
| Performance of fabric | Pleat formability (class) | 5 | 5 | 5 |
| | Pleat retention (class) | 3.5 | 3.5 | 3.5 |
| | Resistance to crease-formation by laundering (class) | 3.8 | 4 | 3.6 |
| | Crease resistance (%) | 70 | 73 | 72 |
| | LOI | 31 | 28 | 29 |
| | Fire retardance (A-4 method) (Carbonization length: cm) | 5.0 | 6.7 | 8.0 |

Example 13

A polymetaphenyleneisophthalamide resin having an intrinsic viscosity of 1.6 was wet-spun and the resultant undrawn filaments were drawn heat-treated, crimped and converted to meta-type aramid staple fibers having an individual fiber thickness of 2.0 deniers, a fiber length of 51 mm, a crimp number of 12 crimps/2.5 cm and an LOI of 30.

Blended spun yarns were produced from a blend of 80% by weight of the above-mentioned meta-type aramid fibers with 20% by weight of fire retardant polyester fibers (available under the trademark of Torevira CS staple fiber, from Hoechst A.G) having an individual fiber thickness of 2.0 deniers, a fiber length of 50 mm and a crimp number of 12 crimps/25.4 mm.

The blended spun yarns were woven to provide a twill fabric having the following structure:

$$\frac{2/68^s \times 2/68^s}{88 \text{ yarns}/25.4 \text{ mm} \times 74 \text{ yarns}/25.4 \text{ mm}}$$

The woven fabric was subjected to a form retention test and fire retardance test. The test results are shown in Table 5.

TABLE 5

| | Item | Example No. Example 13 |
|---|---|---|
| Performance of fabric | Pleat formability (class) | 5 |
| | Pleat retention (class) | 3.5 |
| | Resistance to crease-formation by laundering (class) | 3.8 |
| | Crease resistance (%) | 72 |
| | LOI | 29 |
| | Flame retardance (A-4 method) (Carbonization length: cm) | 5.8 |

CAPABILITY OF EXPLOITATION IN INDUSTRY

The aromatic polyamide fiber-polyester fiber blended spun yarn fabric of the present invention exhibits excellent heat resistance, flame resistance and fire retardance when exposed to flame, has superior form retention, for example, pleat formability (heat setting properties), pleat retention, crease resistance, resistance to crease formation by laundering, and dimensional stability, and thus is useful for forming a flame resistant garment having superior practical usefulness.

We claim:

1. An aromatic polyamide fiber-polyester fiber-blended spun yarn fabric, comprising a fabric made of spun yarns consisting essentially of a uniform blend of:

(A) 60 to 95% by weight of a first fiber component consisting of aromatic polyamide; and (B) 5 to 40% by weight of a second fiber component consisting of polyester fibers, the fabric having a limiting oxygen index of at least 26.

2. The aromatic polyamide fiber-polyester fiber-blended spun yarn fabric as claimed in claim 1, wherein the aromatic polyamide fibers comprise 80 to 100% by weight of meta-type aramid fibers and 0 to 20% by weight of copolymerized para-type aramid fibers.

3. The aromatic polyamide fiber-polyester fiber-blended spun yarn fabric as claimed in claim 2, wherein the meta-type aramid fibers are selected from:

(a) polymetaphenyleneisophthalamide fibers and, (b) fibers comprising a mixture of polymetaphenyleneisophthalamide with at least one member selected from the group consisting of:

(i) a polycondensation reaction product of an amine component comprising 35 to 100 molar % of xylenediamine and 0 to 65 molar % of at least one aromatic diamine with an acid component comprising at least one aromatic dicarboxylic acid;

(ii) a polycondensation reaction product of a diamine component comprising at least one phenylenediamine compound having a phenylene group substituted with at least one alkyl group having 1 to 4 carbon atoms and at least one unsubstituted aromatic diamine compound, with an acid component comprising at least one aromatic dicarboxylic acid, and (iii) a polycondensation reaction product of a diamine component comprising 40 to 100 molar % of at least one penylenediamine compound having a phenylene group substituted with 1 to 4 halogen atoms and 0 to 60 molar % of at least one unsubstituted aromatic diamine compound, with an acid component comprising at least one aromatic dicarboxylic acid.

4. The aromatic polyamide fiber-polyester fiber-blended spun yarn fabric as claimed in claim 2, wherein the copolymerized para-type aramid comprises recurring units of the formula (I):

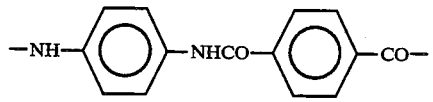

(I)

and recurring units of the formula (II):

$$-NH-Ar_1-NHCO-Ar_2-CO- \quad \text{(II)}$$

wherein, $Ar_1$ and $Ar_2$ respectively and independently of each other represent a member selected from the divalent aromatic cyclic groups of the formulae (III) and (IV):

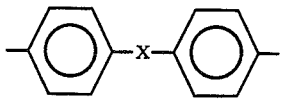

(III)

and

-continued (IV)

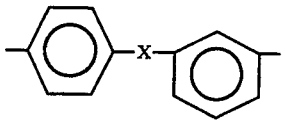

in which X represents a member selected from —O—, —S—,

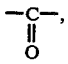

$—CH_2—$ and $—C(CH_3)_2—$ groups, or one of $Ar_1$ and $Ar_2$ represents a divalent aromatic cyclic group of the formula (V):

(V)

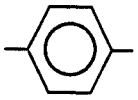

and the other one of $Ar_1$ and $Ar_2$ represents a member selected from the divalent aromatic cyclic groups of the above-mentioned formulae (III) and (IV), which divalent aromatic cyclic groups of the formulae (III), (IV) and (V) may have one or more substituents.

5. The aromatic polyamide fiber-polyester fiber-blended spun yarn fabric as claimed in claim 2, wherein the meta-type aramid fibers have an intrinsic viscosity of 0.8 to 4.0 determined at a resin concentration of 0.5 g/100 ml in a concentrated sulfuric acid solution at a temperature of 30° C.

6. The aromatic polyamide fiber-polyester fiber-blended spun yarn fabric as claimed in claim 1, wherein the aromatic polyamide fibers have a fiber length of 25 to 200 mm and an individual fiber denier of 0.4 to 3.

7. The aromatic polyamide fiber-polyester fiber-blended spun yarn fabric as claimed in claim 1, wherein the polyester fibers have a fiber length of 25 to 200 mm and an individual fiber denier of 0.4 to 3.

8. The aromatic polyamide fiber-polyester fiber-blended spun yarn fabric as claimed in claim 1, wherein the polyester fibers are selected from polyethyleneterephthalate fibers, polybutyleneterephthalate fibers, and polynaphthyleneterephthalate fibers.

* * * * *